US011406237B2

(12) United States Patent
Yildirim et al.

(10) Patent No.: US 11,406,237 B2
(45) Date of Patent: Aug. 9, 2022

(54) SUCTION APPARATUS

(71) Applicant: Robert Bosch GmbH, Stuttgart (DE)

(72) Inventors: Goekhan Yildirim, Neuhausen auf den Fildern (DE); Patrick Schlauch, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/866,784

(22) Filed: May 5, 2020

(65) Prior Publication Data

US 2020/0353484 A1 Nov. 12, 2020

(30) Foreign Application Priority Data

May 8, 2019 (DE) ..... 10 2019 206 568.6

(51) Int. Cl.

| | |
|---|---|
| ***A47L 9/14*** | (2006.01) |
| ***B04C 5/04*** | (2006.01) |
| ***B04C 5/187*** | (2006.01) |
| ***B04C 9/00*** | (2006.01) |
| ***A47L 9/16*** | (2006.01) |

(52) U.S. Cl.

CPC ..... *A47L 9/1427* (2013.01); *A47L 9/1683* (2013.01); *A47L 9/1691* (2013.01); *B04C 5/04* (2013.01); *B04C 5/187* (2013.01); *B04C 9/00* (2013.01); *B04C 2009/004* (2013.01); *B04C 2009/008* (2013.01)

(58) Field of Classification Search

CPC ..... B01D 45/16; B01D 45/12; B01D 45/08; B01D 45/06; B04C 5/187; B04C 5/04; B04C 9/00; B04C 2009/004; B04C 2009/008; A47L 9/1683; A47L 9/1427; A47L 9/1691; A47L 9/16

See application file for complete search history.

(56) References Cited

U.S. PATENT DOCUMENTS

| | | | | |
|---|---|---|---|---|
| 5,090,976 | A | 2/1992 | Dyson | |
| 2014/0093301 | A1* | 4/2014 | Cho | A47L 9/1418 403/24 |

FOREIGN PATENT DOCUMENTS

| | | | |
|---|---|---|---|
| CN | 106037583 | A | 10/2016 |
| DE | 10 2005 053 620 | A1 | 5/2007 |
| DE | 10 2016 224 105 | A1 | 6/2018 |
| EP | 1428 617 | A1 | 6/2004 |
| EP | 2 721 985 | A2 | 4/2014 |

OTHER PUBLICATIONS

Machine Translation (obtained from CNIPA in Jul. 2021) of CN106037583 by Bian et al., "Filter Bag Mounting Structure and Dust collector With Same" (Year: 2016).*

Machine Translation (obtained from Google in Jul. 2021) of DE102016224105 by Hartman et al., "Suction Device" (Year: 2018).*

* cited by examiner

*Primary Examiner* — Robert Clemente

(74) *Attorney, Agent, or Firm* — Maginot, Moore & Beck LLP

(57) ABSTRACT

A suction apparatus includes a housing, at least one cyclone chamber, a collection container configured to as to be releasably connectable to the housing, and having a filter element. The suction apparatus further includes at least one positioning device within the cyclone chamber and configured for positioning at least one collection element within the cyclone chamber.

16 Claims, 4 Drawing Sheets

SUCTION APPARATUS

This application claims priority under 35 U.S.C. § 119 to patent application no. DE 10 2019 206 568.6, filed on May 8, 2019 in Germany, the disclosure of which is incorporated herein by reference in its entirety.

The present disclosure relates to a suction apparatus.

BACKGROUND

A suction device having a housing, having at least one cyclone chamber, having a collection container, wherein the collection container is configured so as to be releasably connectable to the housing, and having a filter element is already known from DE 10 2016 224 105 A1.

SUMMARY

The present disclosure proceeds from a suction apparatus having a housing, having at least one cyclone chamber, having a collection container, wherein the collection container is configured so as to be releasably connectable to the housing, and having a filter element. It is proposed that the suction apparatus for positioning at least one collection element within the cyclone chamber has at least one positioning device within the cyclone chamber.

The disclosure provides a suction apparatus having at least one positioning device, wherein the positioning device enables an improvement in terms of retrieving a substance and/or liquid from the collection container in that the positioning device positions the collection element within the cyclone chamber.

The suction apparatus is configured for collecting and separating particulate matter and/or liquids from the air flow. The air flow is generated by means of the electric motor. The air flow can make its way into the housing by way of an air inlet, wherein the air flow is guided into the collection container by means of a first air duct. The collection container is configured for collecting the particulate matter and/or the liquids, wherein the collection container is releasably connected to the housing of the suction apparatus. The air flow by way of the filter element exits the housing from an air outlet. The filter element is disposed in the cyclone chamber and is in particular releasably connected to the housing. On account thereof, the suction apparatus can be adapted to different fields of application. Filter elements which have specific pores sizes and are adapted as a function of the particle size to be expected can be used, said filter elements effectively separating the particles from the air flow as well as permitting a maximum air flow to pass through. Furthermore, the filter element can advantageously also be replaced in the event of damage, this ensuring a high filtering performance of the suction apparatus during the life span of the latter.

The air inlet and the air outlet of the suction apparatus can be disposed on sides that face away from one another. "Sides that face away from one another" is in particular also to be understood as sides of the suction apparatus that are oriented so as to be substantially perpendicular to one another, or sides that are substantially opposite one another.

An "air flow" is in particular to be understood to be a flow of particles, a fluid, and/or gas, said flow moving through the suction apparatus along a direction of forward movement. A "direction of forward movement" of the air flow is in particular to be understood to be the flow direction of the air flow in the switched-on state of the suction apparatus. The direction of forward movement herein is directed so as to substantially proceed from the air inlet of the suction apparatus in the direction of the air outlet of the suction apparatus. The electric motor which is configured for driving at least one fan unit is advantageously used for generating the air flow. The fan unit can be configured in an exemplary manner as a radial ventilator or an axial ventilator.

A "cyclone chamber" is in particular to be understood to be a region of the suction apparatus in which particulate matter and/or fluid particles are separated from an air flow by way of a centrifugal separation mechanism. The air flow at least in regions is advantageously directed tangentially into the cyclone chamber. The air flow is preferably guided on a circular path at least in regions within the cyclone chamber. The air flow is in particular preferably guided on a circular path about the filter element at least in regions within the cyclone chamber.

The filter element is advantageously configured for filtering particulate matter and/or fluid particles when exiting the cyclone chamber. The cyclone chamber is in particular at least partially delimited by the filter element. The cyclone chamber is preferably configured as a hollow cylinder at least in portions, wherein the external diameter of the hollow cylinder is in particular formed by the collection container, and the internal diameter of the hollow cylinder is in particular formed by the filter element. The filter element can be configured in an exemplary manner as a pleated filter. The external area of the pleated filter corresponds in particular to at least double the lateral shell area of the pleated filter. The filter element is, in particular releasably, connected to the housing. The connection between the filter element and the housing herein can be a screw-fit connection, a clamping connection, a snap-fit connection, a hook connection, or a bayonet connection. In an exemplary manner, a connection between the filter element and the housing of the suction apparatus which is easy to operate as well as secure can be implemented by the bayonet connection.

The positioning device is configured for positioning the collection element within the cyclone chamber, in particular on the collection container. "Positioning" herein is to be understood as disposing in an in particular predetermined position. It is also possible that the positioning device centers the collection element within the cyclone chamber, in particular within the collection container. The collection element can be from a flexible material such as a film from plastics material or a bag from paper, for example. The collection element in an exemplary manner can in particular be configured as a collection pouch, in particular a dust collection pouch, or as a disposal pouch. It is also conceivable that the collection element is configured as a collection bin. The collection container is designed in such a manner that said collection container can receive the collection element. It is conceivable that the collection container can fix the collection element. It is moreover conceivable that the collection container can position and/or center the collection element. To this end, the collection container can have receptacle elements for receiving the collection element. For example, the collection container can have tensioning elements, clamping elements, snap-fitting elements, or hook elements as receptacle elements, or have an at least partially encircling groove for receiving the collection element. The collection element can furthermore have connection elements for connecting to the collection container. For example, the connection elements can be designed in the form of connection openings or a rubber-type encircling connection band.

In one embodiment, the positioning device in the radial direction to a housing axis is disposed between the filter element and the collection container. The housing of the suction apparatus is configured so as to be substantially cylindrical such that at least one longitudinal axis of the housing represents the housing axis. The positioning device in the radial direction proceeding from the housing axis herein is disposed between the filter element and the collection container.

In one embodiment, the positioning device relative to the housing axis is disposed so as to be coaxial between the filter element and the collection container. In this embodiment, the filter element is disposed on the housing axis. The collection container is configured so as to be substantially cylindrical and disposed so as to be coaxial with the housing axis. The positioning device is disposed so as to be coaxial with the housing axis.

In one embodiment, the collection container at least partially receives the positioning device. The collection container herein can receive the positioning device in a force-fitting manner and/or a form-fitting manner. The collection container herein can at least partially enclose the positioning device in the circumferential direction, wherein the circumferential direction can be relative to the housing axis. It is furthermore also conceivable that the collection container at least partially covers or encloses the positioning device in the direction radial and/or axial to the housing axis.

In one embodiment the positioning device is disposed on the housing. The positioning device herein can be connected to the housing in a releasable or a substantially fixed manner. "Substantially fixed" herein is to be understood as not being readily removable from the housing by a user. In the case of the releasable connection between the position device and the housing, the positioning device and/or the housing can have at least one connecting mechanism for the releasable connection. The user herein can connect the positioning device to the housing and remove said positioning device from the housing by means of a connecting mechanism. Furthermore, in the case of the releasable connection between the positioning device and the housing, the positioning device can be configured in the manner of a basket. The collection container in this instance can receive the basket and in the connected state dispose said basket on the housing such that the basket disposes the collection element on the collection container. In the case of the substantially fixed connection between the positioning device and the housing, the positioning device can be connected to the housing by means of fastening elements. The fastening elements can be screws or nuts, for example. Furthermore, in the case of the substantially fixed connection, the housing can configure the positioning device such that the housing and the positioning device are integral.

In one embodiment the positioning device is configured in such a manner that the positioning device, in particular during an operation of the suction apparatus, disposes the collection element on the collection container. As has been described above, the collection container can at least partially receive the positioning device in particular in a force-fitting manner and/or a form-fitting manner. The positioning device preferably disposes the collection element so as to be releasable on an internal face of the collection container. The positioning device is configured in such a manner that said positioning device disposes the collection element on the internal face of the collection container by means of a force which is at least radial and/or axial relative to the housing axis. The positioning device herein can push, press, or clamp the collection element onto the internal face of the collection container, for example. The radial and/or axial force is preferably directed radially outward, so as to point away from the housing axis. The positioning device disposes the collection element on the internal face of the collection container in such a manner so as to prevent the circular path of the air flow about the filter element within the cyclone chamber being disturbed. The positioning device has the effect that the collection element remains disposed on the internal face of the collection container during the operation of the suction apparatus. The collection element by means of the positioning device herein is pushed or pressed, or the like, against the internal face of the collection container.

In one embodiment, the positioning device is additionally configured for holding the collection element, in particular on the positioning device. The positioning device herein can hold the collection element in such a manner that retrieving the collection element from the collection container is facilitated. It is also conceivable that the positioning device fixes the collection element. The positioning device is configured for exerting on the collection element at least one further force which is radial and/or axial relative to the housing axis, so as to hold the collection element. The positioning device herein can tension, push, or clamp the collection element in the direction which is radial and/or axial relative to the housing axis, for example. The further radial and/or axial force is preferably directed radially outward, so as to point away from the housing axis.

In one embodiment, the positioning device has a substantially circular cross section. "Substantially circular" herein is also to be understood as elliptic, annular, or disk-shaped. The positioning device herein has a maximum inscribed circle diameter in the range from 200 mm to 340 mm, particularly 220 mm to 320 mm, most particularly 240 mm to 300 mm. The positioning device herein furthermore has an envelope circle diameter in the range from 210 mm to 350 mm, particularly 220 mm to 340 mm, most particularly 220 mm to 330 mm. The substantially circular cross section herein can correlate with the collection container in such a manner that the collection container can receive the positioning device in a force-fitting manner and/or a form-fitting manner, and can dispose the collection element on the collection container.

In one embodiment, the positioning device has at least one positioning element for positioning the collection element on the collection container. The positioning element is configured in such a manner that said positioning element can position the collection element on the internal face of the collection container by means of the radial and/or axial force. It is also possible that the positioning element disposes, in particular compresses, the collection element on the internal face of the collection container by means of the radial and/or axial force. The positioning element can additionally center the collection element, in particular in the collection chamber and/or the cyclone chamber. For example, the positioning element can be configured so as to be rod-shaped, rod-shaped with a substantially spherical free end, rod-shaped having a free end which is substantially rolled-up and radiused, or so as to be strip-shaped. The free end of the positioning element is configured in such a manner that said free end increases a contact face to the collection element and simultaneously prevents damage to the collection element, in particular during operation of the suction apparatus.

The positioning element relative to the housing axis has an axial length in the range from 100 mm to 210 mm, particularly 120 mm to 190 mm, most particularly 140 mm to 170 mm.

In one embodiment the positioning device has at least one connection element, wherein the connection element is configured for connecting the positioning device to the housing and/or to the collection container. The positioning device herein can connect the positioning device to the housing and/or to the collection container in a releasable or a substantially fixed manner. The connection element can connect the positioning device to the housing and/or to the collection container in a force-fitting manner, a form-fitting manner, and/or a materially integral manner. The connection element can have a receptacle element for receiving at least the fastening element. The positioning device can be connected to the housing and/or to the collection container by means of the fastening element and the receptacle element. For example, the receptacle element can be configured as a receptacle opening, and the fastening element can be configured as a screw. The screw in this instance can herein connect the connection element to the housing and/or to the collection container by means of the receptacle opening. It is also conceivable that the connection element has at least one holding element for connecting the positioning device to the housing and/or to the collection container. The holding element can thus be configured as a snap-fit hook, for example. It is also possible that the connection element is designed as a clamping ring for connecting the positioning device to the housing and/or to the collection container by means of a clamping connection. In an alternative embodiment, the connection element can connect the positioning device to the filter element.

In one embodiment, the positioning device has one or a plurality of frame elements for stabilizing the positioning device. The frame element is configured in such a manner that said frame element keeps the positioning device in a substantially dimensionally stable manner in each operating state of the suction apparatus. The frame element in the operation of the suction apparatus enables in particular the positioning device to be kept in the cyclone chamber in a dimensionally stable manner independently of a strength of the air flow. "Dimensionally stable" herein is to be understood that a shape is maintained despite external forces acting thereon. The positioning element is connected to the frame element. It is conceivable that the positioning element is connected to the frame element in a form-fitting manner, a force-fitting manner, and/or a materially integral manner. The positioning element can thus be connected to the frame element at least by means of a clamping connection, a snap-fit connection, a bayonet connection, and/or a latching connection, for example. It is moreover possible that the frame element is integral to the positioning element. It is moreover possible that the positioning device has a further frame element for stabilizing in the circumferential direction relative to the housing axis. The further frame element can be connected to the positioning element. It is conceivable that the further frame element and the positioning element are integral.

In one embodiment, the positioning device has a plurality of positioning elements. The plurality of positioning elements herein can be in a range from 2 to 20, in particular 2 to 15. The frame element is configured in such a manner that said frame element can receive and connect the plurality of positioning elements. The frame element herein can connect the plurality of positioning elements in a force-fitting, a form-fitting, and/or a materially integral manner. A clamping connection, a snap-fit connection, a latching connection, or a bayonet connection is conceivable for connecting the frame element to the plurality of positioning elements. It is also possible that the frame element is configured so as to be integral to the plurality of positioning elements. The frame element can preferably dispose the plurality of positioning elements in the circumferential direction of the positioning device.

In one embodiment the plurality of positioning elements are disposed at a mutual angular spacing in a range from in each case 10° to 120°, particularly 15° to 100°, most particularly 20° to 90°. The angular spacing is also conceivable to be in a range from 25° to 40°. The positioning elements are preferably disposed uniformly in the circumferential direction to the housing axis. A uniform disposal of the collection element on the collection container can be enabled on account of the disposal at the angular spacing, wherein the circular path of the air flow in the cyclone chamber can be configured and maintained so as to be reduced in terms of interference, in particular so as to be free of interference.

In one embodiment, the plurality of positioning elements is disposed so as to be substantially in the shape of a cylindrical shell. The plurality of positioning elements is disposed on the frame element in such a manner that the plurality of positioning elements configure a type of cylindrical shell. The cylindrical shell has a maximum inscribed circle diameter in the range from 200 mm to 340 mm, particularly 220 mm to 320 mm, most particularly 240 mm to 300 mm. The cylindrical shell furthermore has a cylinder height in the range from 100 mm to 210 mm, particularly 120 mm to 190 mm, most particularly 140 mm to 170 mm. The cylinder height herein can be an axial spacing in the axial direction relative to the housing axis.

In one embodiment the positioning device has at least one further connection element for connecting the positioning device to the collection container and/or to the filter element. The further connection element can be disposed so as to be spaced apart from the connection element. The further connection element can furthermore be disposed on a free end of at least one of the positioning elements. The further frame element can be connected to the further connection element. It is also conceivable that the further frame element and the further connection element are integral. It is also possible that the further connection element is integral to the plurality of positioning elements. The further connection element can connect the positioning device to the collection container and/or to the filter element, wherein a force-fitting and/or a form-fitting connection are/is conceivable.

Moreover proposed is a positioning device as has been described above, for a suction apparatus having a housing, having at least one cyclone chamber, having a collection container, wherein the collection container is configured so as to be releasably connectable to the housing, and having a filter element.

The suction apparatus is preferably a rechargeable-battery operated suction apparatus which is capable of being operated by means of at least one rechargeable battery, in particular by means of a hand-held power tool rechargeable battery pack. On account thereof, the provision of power, for example for the electric motor, in this instance takes place by means of the at least one rechargeable battery by way of the at least one suction-apparatus supply unit. In the context of the present disclosure, a "hand-held power tool rechargeable battery pack" is to be understood to be a combination of at least one rechargeable battery cell and a rechargeable battery pack housing.

The hand-held power tool rechargeable battery pack is advantageously configured to supply power to commercially available rechargeable battery operated hand-held power tools. The at least one rechargeable battery cell can be configured as a li-ion rechargeable battery cell with a nominal voltage of 3.6 V, for example. For example, the hand-held power tool rechargeable battery pack comprises at least five rechargeable battery cells and a total nominal operating voltage of 18 V, so as to enable a suitably powered operation of the suction apparatus. Alternatively, the suction apparatus can be a mains-operated suction apparatus which by means of a power supply cable can be connected to an external mains power socket. The external mains power socket herein can provide a voltage of, for example, 100 V, 110 V, 120 V, 127 V, 220 V, 230 V, or 240 V at 50 Hz or 60 Hz, or else a three-phase AC voltage. The potential design embodiments of the external mains power socket and the available voltages associated therewith are well known to a person skilled in the art.

The housing can furthermore have at least one suction-apparatus operating unit and at least one suction-apparatus holding unit. It is also possible that the housing comprises at least one suction-apparatus mains power socket such that a connected electric apparatus is supplied with power when the suction apparatus per se is supplied with power.

The suction-apparatus operating unit comprises at least one suction-apparatus operating element which is configured for being operated by a user and for generating switching signals. The switching signals in this instance control the suction-apparatus drive, in particular the electric motor. The at least one suction-apparatus operating element can be disposed on a side of the housing. Suction-apparatus operating elements may be a main switch or a setting switch, for example. The main switch is provided for switching the suction-apparatus drive on and off, or to change to an auto-start function. The setting switch is configured for setting a suction output of the suction apparatus. The at least one suction-apparatus operating element is an operating element of the suction apparatus, in particular an operating element as has been described above.

The suction-apparatus holding unit comprises at least one suction-apparatus holding element, for example a suction-apparatus handle, by way of which the user can hold the suction apparatus. Moreover, at least one suction-apparatus mobility unit can be attached to the housing such that the suction apparatus expediently is a mobile suction apparatus. The at least one suction-apparatus mobility unit is configured as at least one roller, at least as a wheel, or the like, so that said suction-apparatus mobility unit can be moved on a hard surface. The mobile suction apparatus is preferably designed as a portable suction apparatus which has rollers, wheels, or the like, or else does not possess any rollers, wheels, or the like. In the context of the present disclosure, the user can take the suction apparatus along and use the latter directly at a desired site.

BRIEF DESCRIPTION OF THE DRAWINGS

The disclosure will be explained hereunder by means of a preferred embodiment. In the drawings hereunder.

DETAILED DESCRIPTION

Figure 1:
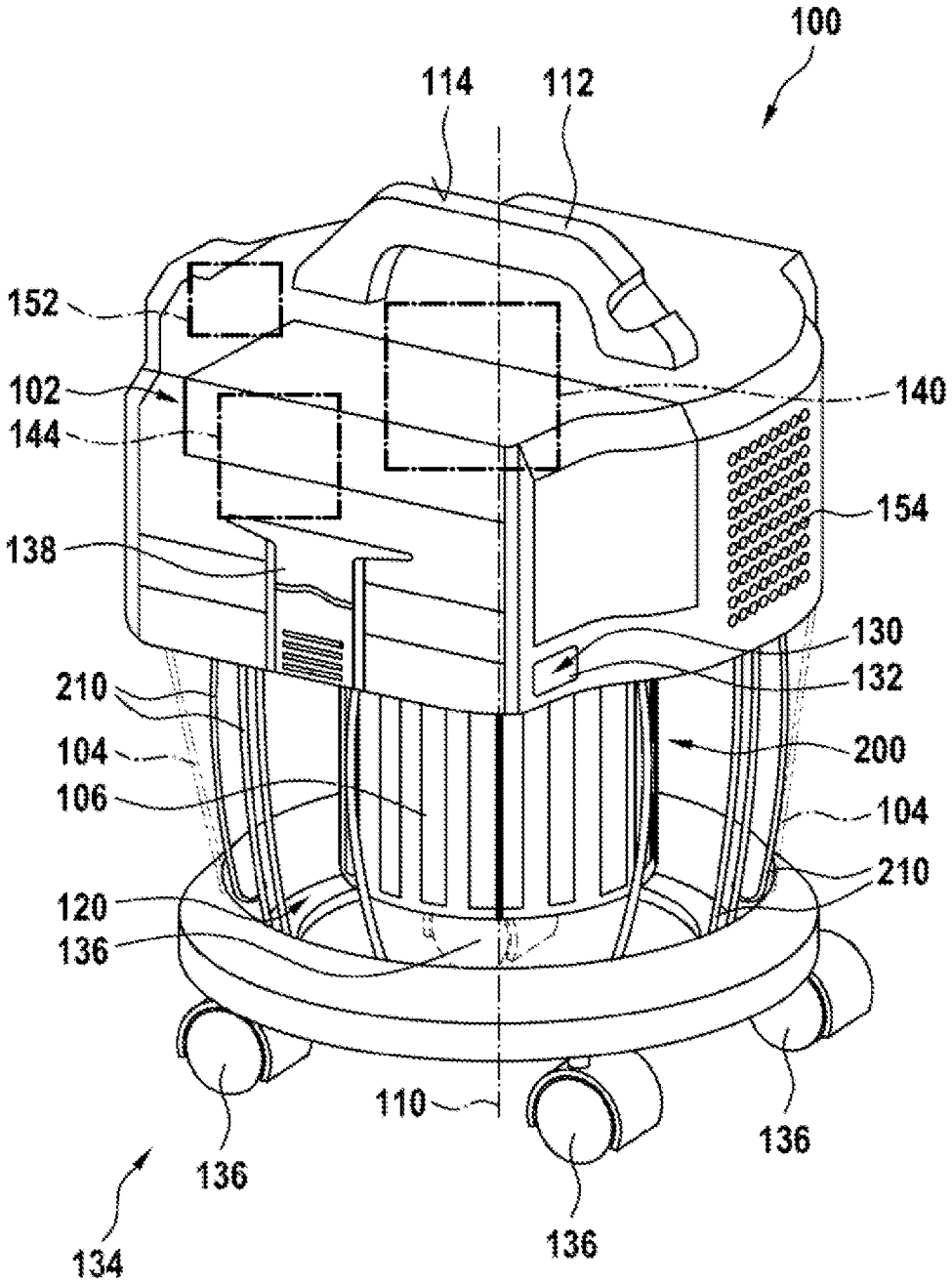
FIG. 1 shows a perspective view of a suction apparatus according to the disclosure.

A suction apparatus 100 according to the disclosure is shown in a perspective view in FIG. 1. The suction apparatus 100 is configured as a centrifugal separator. The suction apparatus 100 has a housing 102 which is releasably connected to a collection container 104 and to a filter element 106. The suction apparatus 100 is designed so as to be substantially cylindrical and extends along a longitudinal axis which represents a housing axis 110. The suction apparatus 100 has a cyclone chamber 120 which in the connected state is axially at least partially delimited by the housing 102 and the collection container 104, and is radially at least partially delimited by the collection container 104 and the filter element 106. The collection container 104 is advantageously configured so as to be at least partially transparent. The releasable connection between the housing 102 and the collection container 104 takes place by way of at least one locking element 138. The locking element 138 is disposed on the housing 102. The locking element 138 is movably connected to the housing 102. The locking element 138 is configured for connecting the housing 102 to the collection container 104 in a force-fitting and a form-fitting manner. The housing 102 here has two locking elements 138 which are disposed so as to be mutually opposite on the housing 102; cf. to this end FIG. 2.

A suction-apparatus holding element 112 is disposed on an upper side of the housing 102. The suction-apparatus holding element 112 is fastened to the upper side of the housing 102. The suction-apparatus holding element 112 is configured as a handle and has a gripping region 114. The gripping region 114 is configured so as to be enclosed by a hand of a user of the suction apparatus 100. On account of the suction-apparatus holding element 112, the suction apparatus 100 can advantageously be carried when in use or for transporting. A suction-apparatus mobility unit 134 is attached to the housing 102. On account thereof, the suction apparatus 100 is configured as a mobile suction apparatus. The suction-apparatus mobility unit 134 has at least one suction-apparatus mobility element 136. The suction-apparatus mobility unit 134 in an exemplary manner has four suction-apparatus mobility elements 136, wherein the suction-apparatus mobility elements 136 are configured in an exemplary manner as rollers. The suction apparatus 100 furthermore has a suction-apparatus operating unit 130 having at least one suction-apparatus operating element 132. The suction-apparatus operating element 132 is configured for being operated by the user and for generating switching signals. The switching signals in this instance control a suction-apparatus drive 140. The suction-apparatus drive 140 has an electric motor 142 and at least one electronics unit. The suction-apparatus operating element 132 can be disposed on a side of the housing 102. The suction-apparatus operating element 132 here in an exemplary manner is configured as a main switch for switching the suction apparatus 100 on and off.

Figure 2:
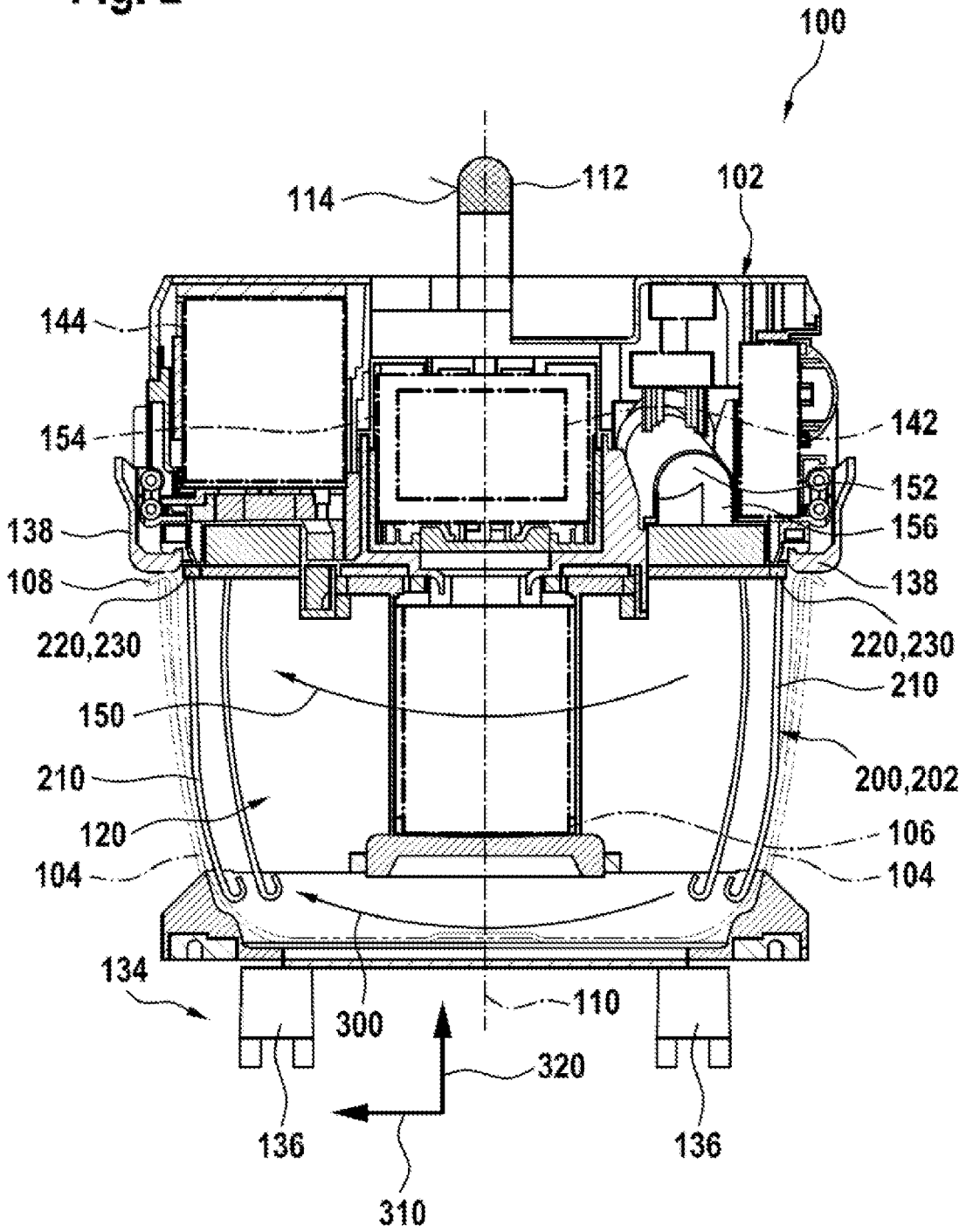
FIG. 2 shows a longitudinal section through the suction apparatus having a first embodiment of a positioning device.

At least one air flow 150 in the cyclone chamber 120 is generated with the aid of the electric motor 142; cf. also FIG. 2. The electric motor 142 herein drives at least one fan unit for generating the air flow 150. The fan unit herein is not illustrated in more detail and in an exemplary manner can be designed as a radial ventilator or an axial ventilator. To this end, the electric motor 142 is supplied with electric power by a suction-apparatus power supply unit 144. The suction apparatus 100 is preferably a rechargeable-battery operated suction apparatus so that the suction-apparatus power supply unit 144 has at least one rechargeable battery. The rechargeable battery is advantageously configured as a hand-held power tool rechargeable battery pack. The provision of the electric power for the electric motor 142 can thus be enabled by way of the suction-apparatus power supply unit 144.

The housing 102 has an air inlet 152 so that the air flow 150 can be directed into the housing 102; cf. also FIG. 2. The housing 102 furthermore comprises an air outlet 154 by way of which the air flow 150 can exit the housing 102. In an exemplary manner, the air inlet 152 and the air outlet 154 of the suction apparatus 100 can be disposed on sides of the housing 102 that face away from one another. The suction apparatus 100 is configured for collecting and separating particulate matter and/or liquids from the air flow 150. The air flow 150 is generated by the electric motor 142. The air inlet 152 serves to enable the air flow 150 to enter the housing 102. The air flow 150 herein is guided into the collection container 104 by means of a first air duct 156; cf. also FIG. 2. The collection container 104 collects the particulate matter and/or the liquids. As has been described above, the collection container 104 is releasably connected to the housing 102 of the suction apparatus 100. The air flow 150 is directed by way of the filter element 106; cf. also FIG. 2. The air flow 150 from the housing 102 is furthermore guided by way of a second air duct and by way of the air outlet 154. The second air duct is not illustrated in more detail here. The cyclone chamber 120 receives the filter element 106 such that the filter element 106 in the connected state is disposed in the cyclone chamber 120. Furthermore, the filter element 106 is releasably connected to the housing 102. The filter element 106 in an exemplary manner herein can be releasably connected to the housing 102 of the suction apparatus 100 by way of a bayonet connection. The filter element 106 at least partially delimits the cyclone chamber 120. The filter element 106 is designed as a pleated filter, for example.

The particulate matter and/or fluid particles are separated from the air flow 150 by way of a centrifugal separator mechanism in the cyclone chamber 120. In this embodiment, the air flow 150 at least in regions is guided tangentially into the cyclone chamber 120. The air flow 150 is subsequently guided on a circular path at least in regions within the cyclone chamber 120. In the case of this circular path, the air flow 106 within the cyclone chamber 120 is guided about the filter element 106. The cyclone chamber 120 at least in portions here is designed as a hollow cylinder. An external diameter of the hollow cylinder is formed by the collection container 104, and an internal diameter of the hollow cylinder is formed by the filter element 106.

The suction apparatus 100 for positioning at least one collection element 108 within the cyclone chamber 120 furthermore comprises at least one positioning device 200 within the cyclone chamber 120. The positioning device 200 is configured for positioning the collection element 108 within the cyclone chamber 120. For example, the positioning device 200 can additionally center the collection element 108; cf. also FIG. 2. The collection element 108 in an exemplary manner can be designed as a collection pouch or as a disposal pouch, or alternatively as a collection bin. The collection container 104 is configured for receiving the collection element 108.

A longitudinal section through the suction apparatus 100 having a first embodiment 202 of the positioning device 200 is illustrated in FIG. 2. In the case of the first embodiment 202, the positioning device 200 is connected to the housing 102. The positioning device 200, in the radial direction 310 to the housing axis 110, is disposed between the filter element 106 and the collection container 104. As has been described above, the housing 102 of the suction apparatus 100 is designed so as to be substantially cylindrical. The longitudinal axis of the housing 102 herein represents the housing axis 110. The positioning device 200 herein in the radial direction 310 proceeding from the housing axis 110 is disposed between the filter element 106 and the collection container 104. Moreover, the positioning device 200 relative to the housing axis 110 is disposed so as to be coaxial between the filter element 106 and the collection container 104. The filter element 106 here is disposed on the housing axis 110. The collection container 104 is configured for at least partially receiving the positioning device 200. The collection container 104 can receive the positioning device 200 in a force-fitting manner and/or a form-fitting manner. For example, the collection container 104 at least partially encloses the positioning device 200 in the circumferential direction 300. The circumferential direction 300 here is relative to the housing axis 110. The positioning device 200 is moreover disposed on the housing 102. The positioning device 200 in this embodiment is connected in a substantially fixed manner to the housing 102 by means of fastening elements. For example, the fastening elements can be designed as screws or nuts.

The positioning device 200 is designed for disposing the collection element 108 on an internal face of the collection container 104. For example, the positioning device 200 can dispose the collection element 108 on the internal face of the collection container 104 during an operation of the suction apparatus 100. The positioning device 200 disposes the collection element 108 so as to be releasable on the internal face of the collection container 104. The positioning device 200 pushes, presses, or clamps the collection element 108 onto the internal face of the collection container 104 with the aid of a force which is radial and/or axial relative to the housing axis 110. The radial and/or axial force is directed outward, so as to point away from the housing axis 110. The positioning device 200 for disposing the collection element 108 on the collection container 104 is designed in such a manner that the circular path of the air flow 150 about the filter element 106 within the cyclone chamber 120 can be configured so as to be substantially reduced in terms of interference. The positioning device 200 is furthermore configured for holding the collection element 108. The positioning device 200 can hold the collection element 108 in such a manner that retrieving of the collection element 108 from the collection container 104 is facilitated. The positioning device 200 here is additionally configured for exerting on the collection element 108 at least one further force which is radial and/or axial relative to the housing axis 110. On account thereof, the positioning device 200 can tension, push, or clamp the collection element 108 in the radial/and or axial direction 310, 320, for example.

Figure 3:
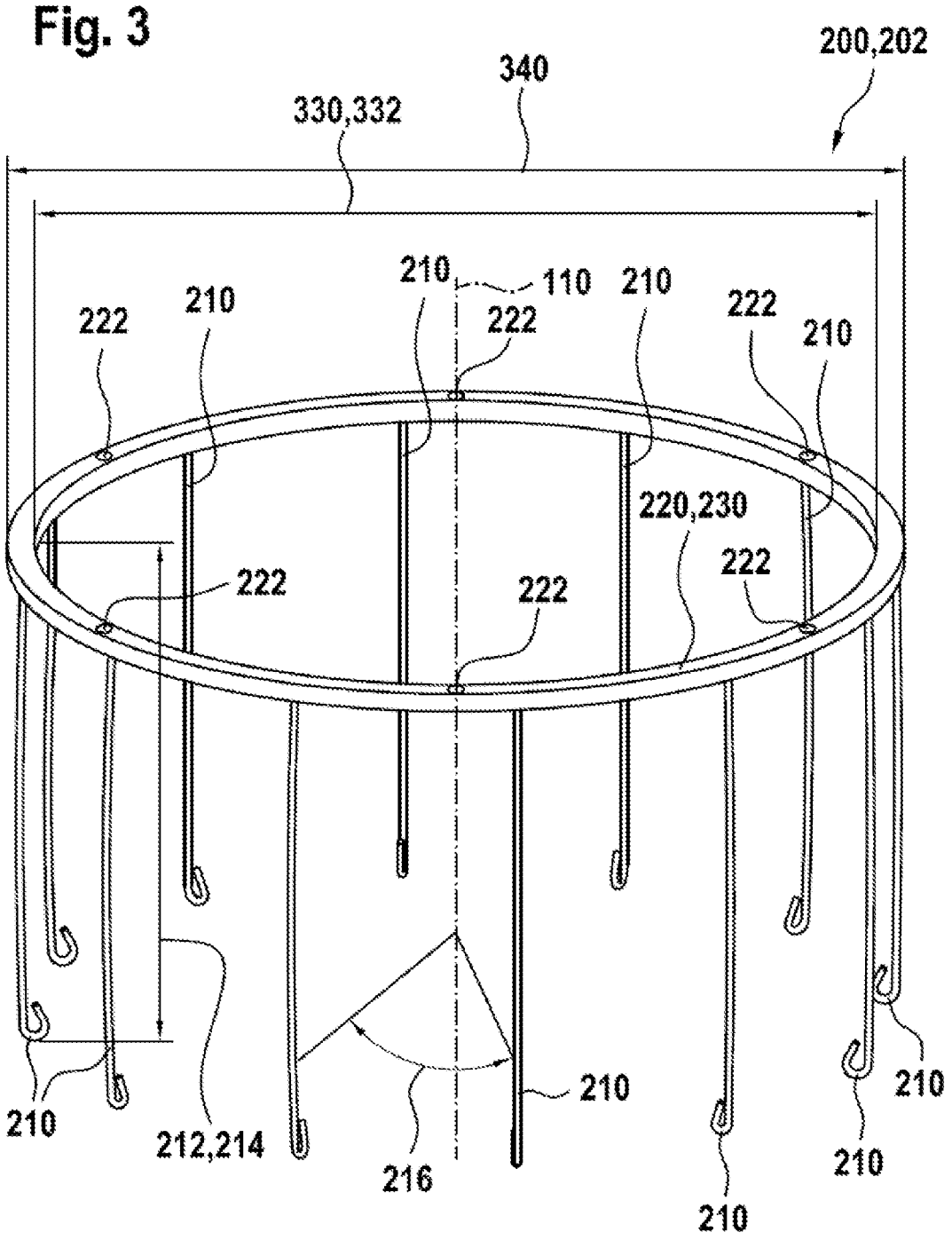
FIG. 3 shows a perspective view of the first embodiment of the positioning device.

A perspective view of the positioning device 200 is shown in FIG. 3. The positioning device 200 comprises a substantially circular cross section. The positioning device 200 herein comprises a maximum inscribed circle diameter 330 in the range from 200 mm to 340 mm. The positioning device 200 moreover comprises an envelope circle diameter 340 in the range from 210 mm to 350 mm. The positioning device 200 here comprises a plurality of positioning elements 210. The positioning elements 210 are configured for positioning the collection element 108 on the internal face the collection container 104. The positioning elements 210 are configured for positioning the collection element 108 on the internal face of the collection container 104 with the aid of the radial and/or axial force. The positioning elements 210 here in an exemplary manner are designed so as to be rod-shaped having a substantially free end which is rolled-up and radiused. The positioning elements 210 herein comprise in each case an axial length 212 in the range from 100 mm to 210 mm. The positioning device 200 furthermore comprises a frame element 230 for stabilizing the positioning device 200 within the collection container 104.

The positioning elements 210 are disposed on the frame element 230. The positioning elements 210 can thus be connected to the frame element 230 in a force-fitting manner, a form-fitting manner, and/or a materially integral manner. In this embodiment, the positioning elements 210 and the frame element 230 are configured so as to be integral. The frame element 230 disposes the positioning elements 210 at a mutual angular spacing 216 in a range of in each case 10° to 120°. The positioning elements 210 here are disposed uniformly in the circumferential direction 300 to the housing axis 110. The positioning elements 210 are disposed in such a manner that said positioning elements 210 are disposed so as to be substantially in the shape of a cylindrical shell. The positioning elements 210 by virtue of the disposal thereof on the connection element 220 configure a type of cylindrical shell. The cylindrical shell herein comprises a maximum inscribed circle diameter 332 in the range from 200 mm to 340 mm. Moreover, the cylindrical shell comprises a cylinder height 214 in the range from 100 mm to 210 mm.

The positioning device 200 furthermore comprises at least one connection element 220 for connecting the positioning device 200 to the housing 102. The connection element 220 here is fastened to the housing 102 in a substantially fixed manner by means of fastening elements. The connection element 220 can moreover comprise at least one receptacle element 222 which is configured for receiving the fastening elements. The positioning device 200 can be connected to the housing 102 with the aid of the fastening elements and the receptacle elements 222. The receptacle element 222 here is designed as a receptacle opening, and the fastening element is designed as a screw. Moreover, six receptacle openings are provided here, wherein the fastening elements are not illustrated in more detail. In this embodiment, the positioning elements 210, the frame element 230, and the connection element 220 are designed so as to be integral.

Figure 4:
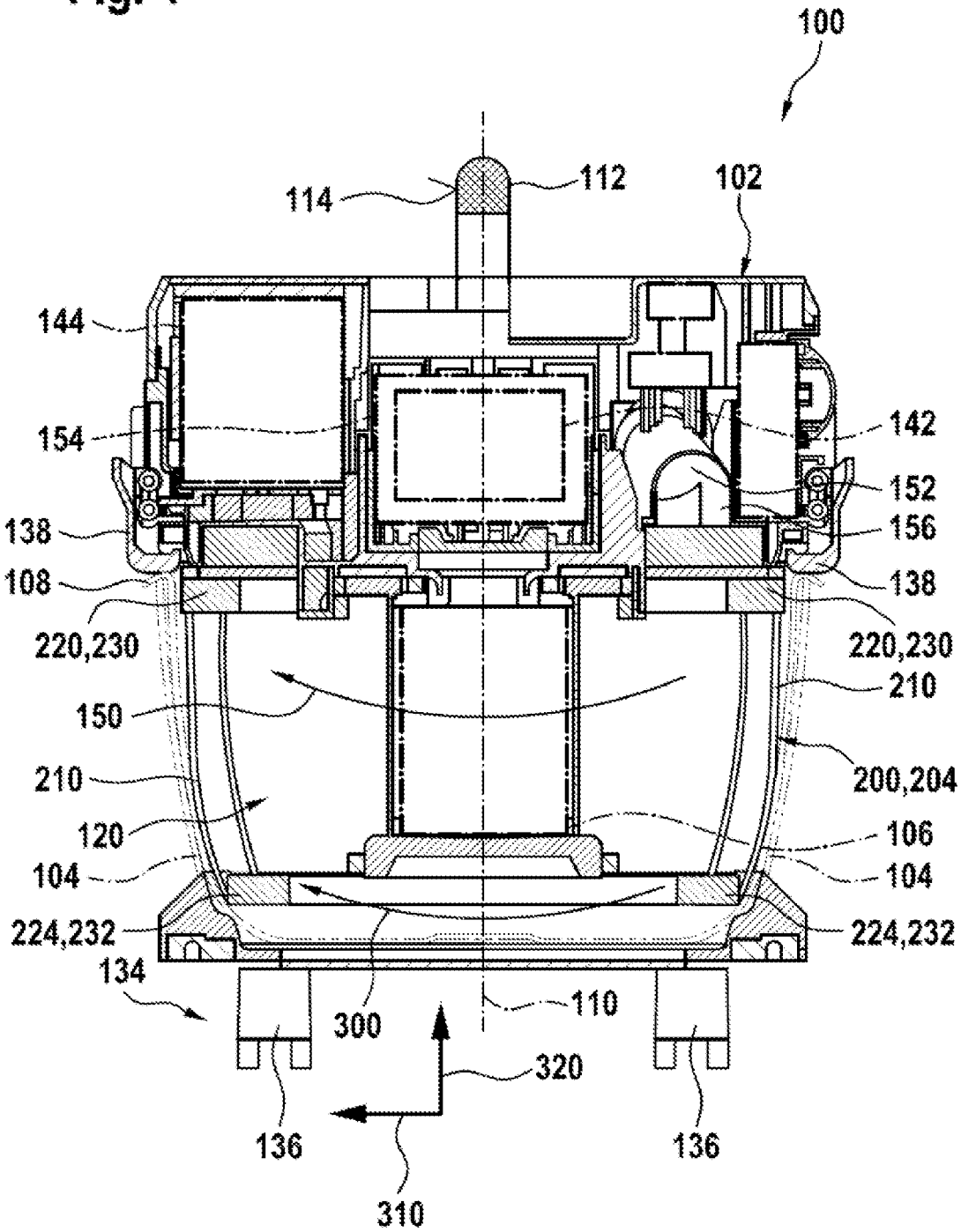
FIG. 4 shows a longitudinal section through the suction apparatus having a second embodiment of the positioning device.

A longitudinal section through the suction apparatus 100 having a second embodiment 204 of the positioning device 200 is illustrated in FIG. 4. In the second embodiment 204, the positioning device 200 is releasably connected to the housing 102, and is configured in the manner of a basket. The positioning device 200 in this embodiment has the frame element 230 for disposing the positioning elements 210 uniformly in the circumferential direction, as well as a further frame element 232 for stabilizing the positioning device 200 in the collection container 104. The frame element 230 and the further frame element 232 in this embodiment are in each case configured so as to be annular and are connected to one another by means of the positioning elements 210. The collection container 104 can receive the second embodiment 204 of the positioning device 200 in a form-fitting manner. To this end, the positioning device 200 in this embodiment has the connection element 220 for the releasable connection to the housing 102 and to the collection container 104, as well as a further connection element 224 for the releasable connection to the collection container 104 and/or to the filter element 106. In this embodiment, the frame element 230 configures the connection element 220. Furthermore, the further frame element 232 here configures the further connection element 224. Moreover, the connection element 220, the further connection element 224, the frame element 230, the further frame element 232, and the positioning elements 210 here are configured so as to be integral. The collection element 108 in the radial direction 310 is disposed between the collection container 104 and the positioning device 200. The positioning device 200 holds the collection element 108 on the internal face of the collection container 104.

The invention claimed is:

1. A suction apparatus comprising:

a housing;

at least one cyclone chamber;

a collection container configured to as to be releasably connectable to the housing;

a filter element; and at least one positioning device arranged within the cyclone chamber in such a way that the at least one positioning device is at least partially spaced apart from an outer extent of the at least one cyclone chamber, the at least one positioning device configured for positioning at least one collection element within the cyclone chamber, wherein the filter element is spaced apart from the at least one collection element.

2. The suction apparatus according to claim 1, wherein the positioning device is configured in such a manner that the positioning device urges the collection element into contact with the collection container during operation of the suction apparatus.

3. The suction apparatus according to claim 1, wherein the positioning device is further configured to hold the collection element on the positioning device.

4. The suction apparatus according to claim 1, wherein the positioning device is disposed radially between the filter element and the collection container.

5. The suction apparatus according to claim 1, wherein, relative to a housing axis, the positioning device is disposed coaxially between the filter element and the collection container.

6. The suction apparatus according to claim 1, wherein the collection container at least partially receives the positioning device.

7. The suction apparatus according to claim 1, wherein the positioning device is disposed on the housing.

8. The suction apparatus according to claim 1, wherein the positioning device has a substantially circular cross section.

9. The suction apparatus according to claim 1, wherein the positioning device comprises at least one positioning element for positioning the collection element on the collection container.

10. The suction apparatus according to claim 9, wherein the at least one positioning element includes a plurality of positioning elements.

11. The suction apparatus according to claim 10, wherein the plurality of positioning elements are disposed at a mutual angular spacing of from 10° to 120° relative one another.

12. The suction apparatus according to claim 11, wherein the mutual angular spacing is from 15° to 100°.

13. The suction apparatus according to claim 11, wherein the mutual angular spacing is from 20° to 90°.

14. The suction apparatus according to claim 1, wherein the positioning device comprises at least one connection element configured for connecting the positioning device to at least one of the housing, the collection container, and the filter element.

15. The suction apparatus according to claim 14, wherein the positioning device comprises at least one further connection element configured to connect the positioning device to at least one of the collection container and the filter element.

16. The suction apparatus according to claim 1, wherein the positioning device comprises at least one frame element configured to stabilize the positioning device.

* * * * *